US009242362B2

(12) United States Patent
Abante et al.

(10) Patent No.: US 9,242,362 B2
(45) Date of Patent: Jan. 26, 2016

(54) SLIDE SWITCH FOR A POWER TOOL

(75) Inventors: Edward Abante, Chicago, IL (US); Mike Landt, Chicago, IL (US); Daniel Blythe, Arlington Heights, IL (US)

(73) Assignee: Robert Bosch GmbH, Stuttgart (DE)

( * ) Notice: Subject to any disclaimer, the term of this patent is extended or adjusted under 35 U.S.C. 154(b) by 700 days.

(21) Appl. No.: 13/606,091

(22) Filed: Sep. 7, 2012

(65) Prior Publication Data

US 2014/0069676 A1 Mar. 13, 2014

(51) Int. Cl.

| | |
|---|---|
| ***B25F 5/00*** | (2006.01) |
| ***B25B 21/00*** | (2006.01) |
| ***B25B 23/14*** | (2006.01) |
| ***H01H 9/06*** | (2006.01) |
| ***H01H 15/24*** | (2006.01) |

(52) U.S. Cl.

CPC . *B25F 5/001* (2013.01); *B25F 5/00* (2013.01); *H01H 9/061* (2013.01); *H01H 15/24* (2013.01)

(58) Field of Classification Search

CPC ..... B25F 5/00; B25F 5/001; B25B 21/00; B25B 23/14

USPC ..... 173/176, 217, 2, 170; 310/50; 318/571, 318/262; 200/178, 536, 547

See application file for complete search history.

(56) References Cited

U.S. PATENT DOCUMENTS

| | | | | |
|---|---|---|---|---|
| 3,328,613 | A * | 6/1967 | Gawron | 310/48 |
| 3,415,966 | A * | 12/1968 | Matthews | 200/522 |
| 3,484,632 | A * | 12/1969 | Opalenik et al. | 310/68 R |
| 3,959,883 | A | 6/1976 | Walls et al. | |
| 4,286,125 | A * | 8/1981 | Schaffeler et al. | 200/6 B |
| 4,903,318 | A | 2/1990 | Nagata | |
| 5,298,821 | A | 3/1994 | Michel | |
| 6,380,502 | B1 | 4/2002 | Hirschburger et al. | |
| 2009/0211886 | A1 * | 8/2009 | Aoki et al. | 200/252 |
| 2010/0206703 | A1 | 8/2010 | Puzio et al. | |

FOREIGN PATENT DOCUMENTS

| | | | |
|---|---|---|---|
| DE | 4410312 | A1 | 9/1995 |
| DE | 102009009965 | A1 | 8/2010 |
| EP | 1788597 | A1 | 5/2007 |
| EP | 2030710 | A2 | 3/2009 |
| EP | 2639016 | A1 | 9/2013 |
| WO | 0159405 | A1 | 8/2001 |
| WO | 2012063543 | A1 | 5/2012 |

OTHER PUBLICATIONS

International Search Report and Written Opinion corresponding to PCT Application No. PCT/US2013/058578, mailed Feb. 27, 2014 (13 pages).

* cited by examiner

*Primary Examiner* — Michelle Lopez

(74) *Attorney, Agent, or Firm* — Maginot Moore & Beck LLP

(57) ABSTRACT

A power tool includes a variable speed motor coupled to a drive member. A power circuit electrically connects the variable speed motor to a power source. A variable speed signal generator generates a variable speed control signal indicating an operating speed for the motor. The operating speed is dependent upon a value of a variable speed selection signal generated by a slide switch. The slide switch includes a linear slide potentiometer for generating the variable speed selection signal. An actuator slides along the potentiometer to control the value of the selection signal. The slide switch includes an ON/OFF contact and a lever arm that is movable into and out of contact with the ON/OFF contact. The actuator is configured to prevent the lever arm from contacting the ON/OFF contact when the actuator is in an OFF position in relation to the slide potentiometer thereby opening the power circuit.

12 Claims, 3 Drawing Sheets

SLIDE SWITCH FOR A POWER TOOL

TECHNICAL FIELD

The present invention relates to power tools and in particular to mechanisms for controlling the speed of a rotary power tool output shaft.

BACKGROUND

In general, rotary power tools are light-weight, handheld power tools capable of being equipped with a variety of tool accessories and attachments, such as cutting blades, sanding discs, grinding tools, and many others. These types of tools typically include a generally cylindrically-shaped main body that serves as an enclosure for an electric motor as well as a hand grip for the tool. The electric motor is operably coupled to a drive member that extends from the nose of the housing. The electric motor is configured to rotate the drive member at relatively high frequencies. The drive member includes a tool holder that is configured to retain various accessory tools so they are driven to rotate along with the drive member.

Rotary power tools are often configured for variable speed operation. Slide switches have been used to provide variable speed control in rotary power tools. Typically, the slide switch is located near the cord end of the tool and is movable in a circumferential direction between an off position and a maximum speed position. The slide switch has a switch lever that generally follows the curvature of the cylindrical configuration of the housing. While effective for variable speed control of the tool, multiple "swipes" of the dial are required to cover the entire speed range of the tool. In addition, in some cases, the tool is provided with a separate switch for turning the tool on and off.

SUMMARY

In accordance with one embodiment, a power tool is provided that includes a housing defining a longitudinal axis. A variable speed motor is supported by the housing, and a drive member is coupled to the motor that defines an axis of rotation aligned with the longitudinal axis. The drive member includes a tool holder located exterior to the housing. A power circuit electrically connects the variable speed motor to a power source. The tool includes a variable speed signal generator that generates a variable speed control signal indicating an operating speed for the motor. The operating speed is dependent upon a value of a variable speed selection signal. A slide switch is attached to the housing that includes i) a slide potentiometer that outputs the variable speed selection signal, and ii) an actuator configured to slide between a first position and a second position in relation to the slide potentiometer. The variable speed selection signal has a value that varies corresponding to a position of the actuator in relation to the slide potentiometer. The slide switch includes an ON/OFF contact and an ON/OFF lever arm that is movable into and out of contact with the ON/OFF contact. The ON/OFF contact and the ON/OFF lever arm are electrically connected to the power circuit such that the power circuit is closed when the ON/OFF lever arm is positioned in contact with the ON/OFF contact and the power circuit is opened when the ON/OFF lever arm is spaced apart from the ON/OFF contact. When the actuator is located at the first position, the actuator prevents the ON/OFF lever arm from contacting the ON/OFF contact, and, when the actuator is away from the first position, the ON/OFF lever arm is positioned in contact with the ON/OFF contact.

DRAWINGS

Figures 5A, 5B, 5C:
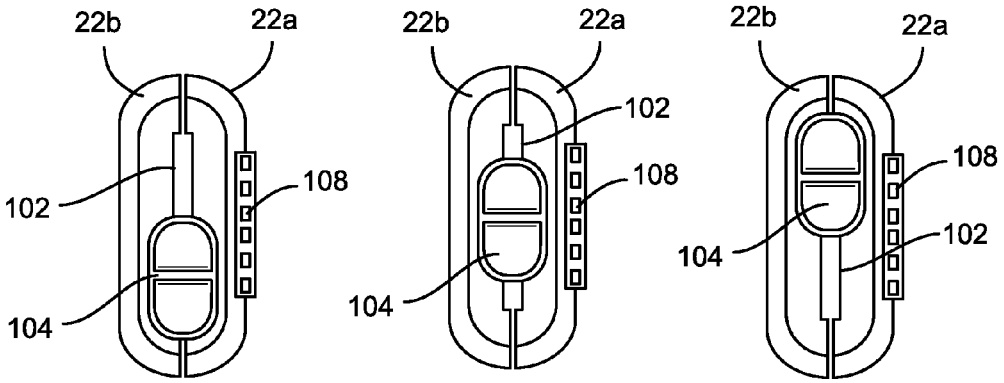

FIGS. 5A, 5B, and 5C depict the switch knob of the slide switch in the OFF position, an ON/mid-speed position, and an ON/Maximum speed position, respectively.

Figure 1:
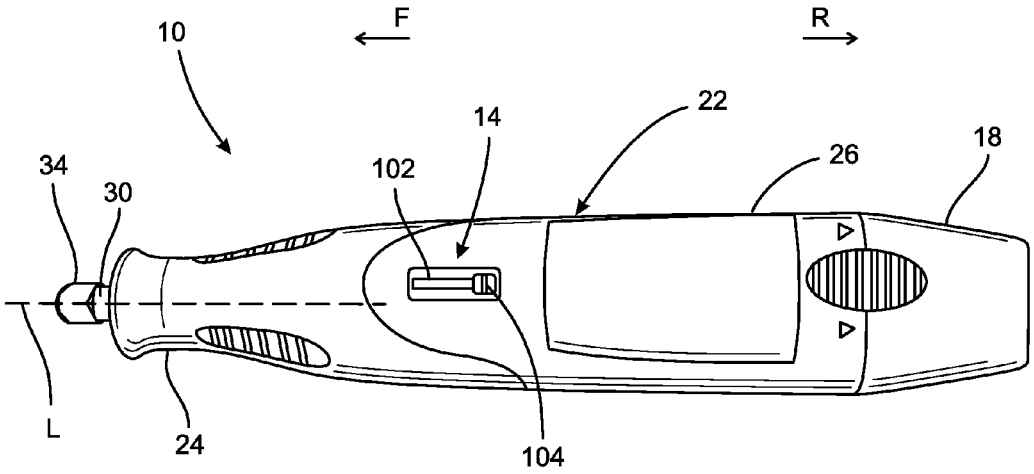
FIG. 1 is a perspective view of rotary power tool including a slide switch in accordance with the present disclosure.
Figure 6:
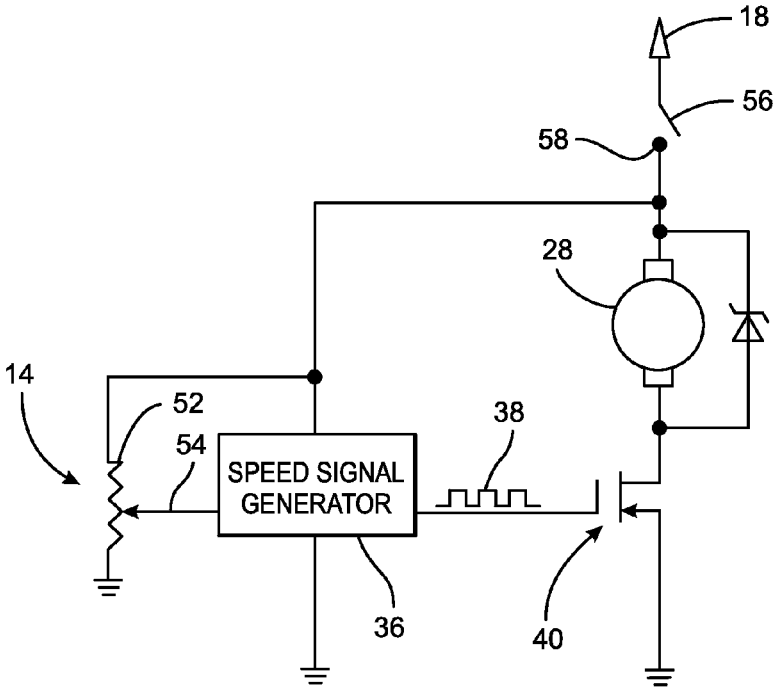

FIG. 6 is a circuit diagram of the variable speed and power circuits of the rotary power tool of FIG. 1.

DESCRIPTION

For the purposes of promoting an understanding of the principles of the invention, reference will now be made to the embodiments illustrated in the drawings and described in the following written specification. It is understood that no limitation to the scope of the disclosure is thereby intended. It is further understood that the disclosure includes any alterations and modifications to the illustrated embodiments and includes further applications of the principles of the disclosure as would normally occur to one of ordinary skill in the art to which this disclosure pertains.

Referring to FIG. 1, the present disclosure is directed to a rotary power tool 10 including a linear slide switch 14 that is configured to provide variable speed control of the rotational velocity of the drive member as well as provide ON/OFF functionality for the tool 10 based on the position of the switch. The slide switch 14 eliminates the need for a separate switch for turning the tool 10 on and off. In addition, the linear slide switch 14 has a linear path of motion that is aligned with the longitudinal axis L of the tool 10 which allows users to turn the tool 10 from OFF to maximum speed and vice versa in one smooth motion.

With continuing reference to FIG. 1, the rotary power tool 10 includes a generally cylindrically shaped housing 22 constructed of a rigid material such as plastic, metal, or composite materials such as a fiber reinforced polymer. The housing 22 defines a longitudinal axis L and includes a nose portion 24 and a handle portion 26. The handle portion 26 encloses a motor 28 (FIG. 6). In one embodiment, the motor 28 comprises an electric motor configured to receive power from a rechargeable battery 18 connected at the base of the handle portion 26. In other embodiments, electric power for the motor may be received from an AC outlet via a power cord (not shown).

The motor 28 is coupled to a drive member 30 that extends from the nose portion 24 of the housing in coaxial alignment with the longitudinal axis L. The drive member 30 includes a tool holder 34 that is configured to releasably retain various accessory tools (not shown), such as grinding wheels and cutting discs, exterior to the nose portion 24 of the housing 22. As the tool holder 34 is rotated by the drive member 30, an accessory tool is driven to rotate about the axis L of the drive member 30. In one embodiment, the tool holder 34 comprises a chuck or collet that is configured to clamp onto the shank of an accessory tool. In alternative embodiments, the tool holder 34 and accessory tools may be provided with interlocking drive structures (not shown) that mate to secure the accessory tool to the tool holder 34.

Referring to FIG. 6, the motor 28 comprises a variable speed motor that is configured to rotate the drive member 30 about the axis L at high frequencies, e.g., 5,000 to 30,000 rotations per minute. Power to the motor 28 and the rotational speed of the motor 28 is controlled by the linear slide switch 14. The switch 14 is provided on the handle portion 26 of the housing 22 with the path of movement of the switch aligned with the longitudinal axis L of the housing 22.

The operating speed of the motor 28 is controlled by a speed signal output by a speed signal generator 36. In one embodiment, the speed signal generator comprises an oscillator or similar type of structure configured to generate a pulsed output signal 38. The pulsed output signal 38 is used to open and close a power transistor 40 that controls the flow of current to the motor 28 from the power source 18. The operating speed of the motor 28 depends on the duty cycle of the pulsed output 38. The duty cycle of the pulsed output 38 in turn is controlled by a speed selection signal output by the slide switch. The speed selection signal has a value that is dependent upon on the position of the slide switch 14. The value of the speed selection signal is used to control the duty cycle of the pulsed output 38 of the speed signal generator 36.

Figure 2:
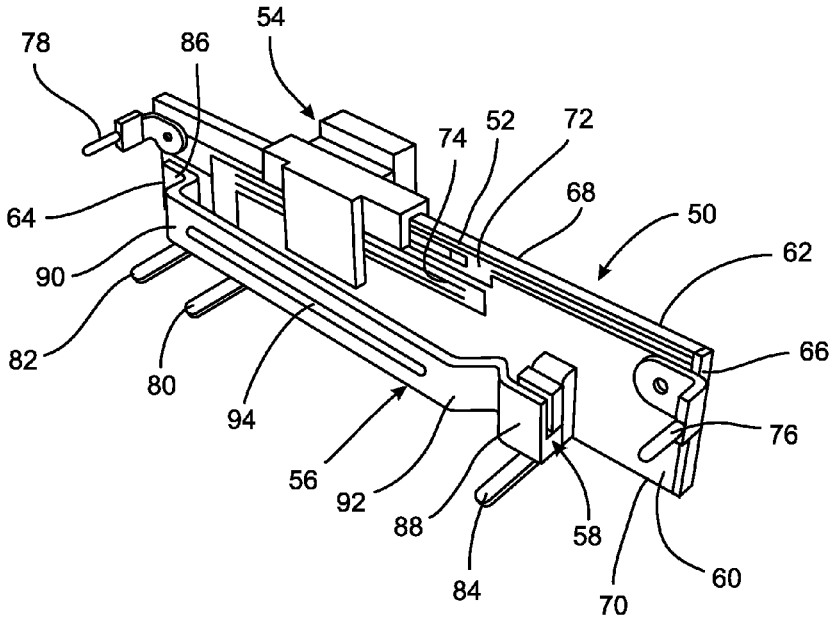
FIG. 2 is a perspective view of the slide switch assembly of the rotary power tool of FIG. 1.

Referring now to FIG. 2, the slide switch 14 includes a switch body 50 that supports a slide potentiometer 52, an actuator 54, an ON/OFF lever arm 56, and an ON/OFF contact 58. The switch body 50 comprises a planar member, such as a substrate or plate, formed of a non-conductive material and/or insulative material, such as plastic, FR4. As depicted in FIG. 2, the switch body 50 has a generally rectangular shape with opposing main surfaces, i.e., a first main surface 60 and a second main surface 62. The rectangular switch body 50 also includes a first short edge portion 64, a second short edge portion 66, a first long edge portion 68, and a second long edge portion 70.

Figure 3:
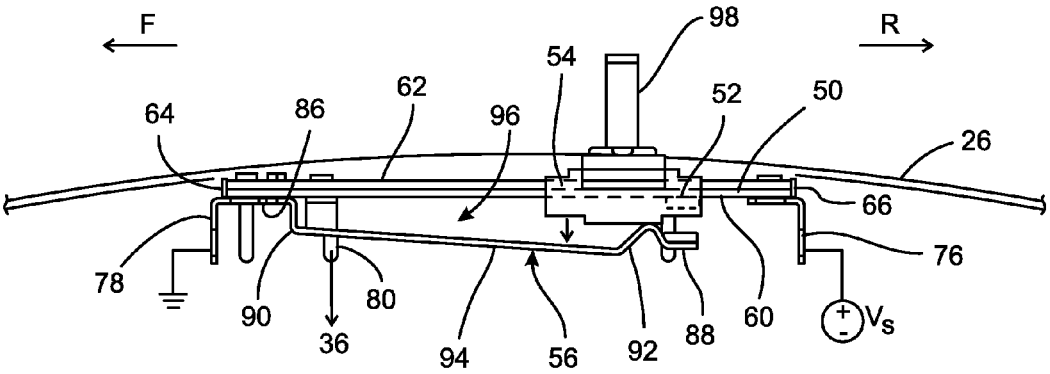
FIG. 3 is a side elevational view of the slide switch assembly of FIG. 2 with the slider in the ON position.
Figure 4:
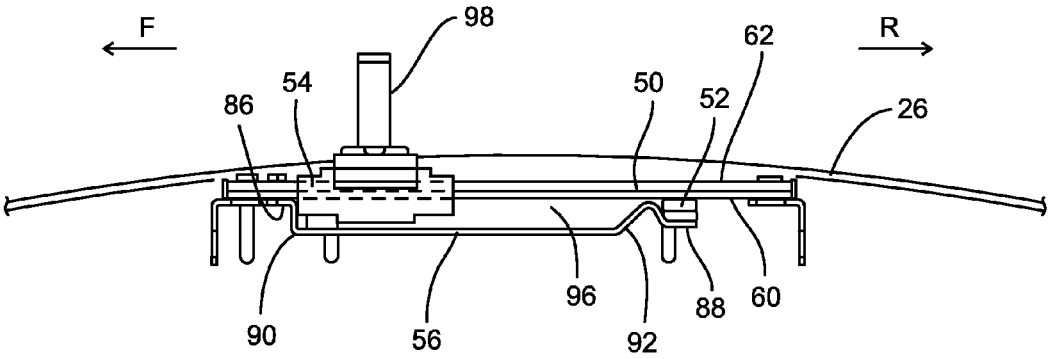
FIG. 4 is a side elevational view of the slide switch assembly of FIG. 2 with the slider in the OFF position.

Referring to FIGS. 3 and 4, the switch body 50 is attached to the housing 22 of the tool 10 with the second main surface 62 facing away from the interior of the housing 22 and the first main surface 60 facing inwardly toward the interior of the housing 22. The switch body 50 is positioned with the first short edge portion 64, referred to hereafter as the leading edge portion, oriented in the forward direction F toward the nose portion 24 of the housing 22 and the second short edge portion 66, referred to hereafter as the trailing edge portion, oriented in the rearward direction R toward the base of the handle portion 26 of the housing 22.

The slide potentiometer 52 is provided on the switch body 50. The slide potentiometer includes a resistive strip 72, a conductive strip 74, and a sliding contact (not visible). The resistive strip 72 comprises a generally rectangular strip of resistive material provided on the first main surface 60 of the switch body 50 extending between the leading edge portion 64 and trailing edge portion 66. The conductive strip 74 is arranged generally parallel to and spaced apart from the resistive strip 72 extending along a portion of the distance between the leading and trailing edge portions 64, 66 of the switch body 50.

The actuator 54 is formed of a non-conductive material, such as plastic, and is slidably mounted onto the switch body. As depicted in FIGS. 2-4, the actuator 54 is configured to wrap around the switch body 50 so that a portion of the actuator 54 is arranged on each side of the switch body. The sliding contact (not shown) is mounted to the portion of the actuator 54 that faces the first main surface 60 and serves to electrically connect the resistive strip 72 to the conductive strip 74 as the actuator 54 slides along the switch body 50.

Wiring terminals 76, 78, 80, 82, 84 are attached to the switch body 50 for electrically coupling the resistive strip and conductive strip to speed control wiring 86. In one embodiment, terminal 76 electrically connects one end of the resistive strip 72 to ground and terminal 78 electrically connects the other end of the resistive strip 72 to a fixed input voltage Vs. The terminal 80 is electrically connected to an end of the conductive strip 74 to serve as the output terminal for the slide potentiometer 52. In one embodiment, the output voltage at the terminal is a function of the input voltage Vs and the position of the sliding contact 14 along the resistive strip 72.

The actuator 54 is supported by the switch body 50 for sliding movement between a first position, e.g., a forwardmost position, (FIG. 4) proximate the leading edge portion 64 of the switch body 50 and a second position, e.g., rearwardmost position, (FIG. 3) proximate the trailing edge portion 66 of the switch body 50. In the embodiment of FIGS. 2-4, the forwardmost position (FIG. 4) of the actuator 54 corresponds to the ON/maximum speed position, and the rearwardmost position (FIG. 3) corresponds to the OFF position. As can be seen in FIG. 2, the conductive strip 74 does not extend all to the trailing edge portion 66 resulting in the sliding contact (not shown) moving out of contact with the resistive and conductive strips 72, 74 when the sliding contact reaches the rearwardmost position. When the sliding contact moves off of the resistive and conductive strips, the output of the sliding potentiometer 52 at terminal 80 is grounded indicating that no power is to be provided to the motor 28.

The slide switch 14 includes ON/OFF functionality for cutting power to the tool 10 when the actuator 54 is at the OFF position (FIG. 3). The ON/OFF functionality is provided in part by the ON/OFF lever arm 56 and the ON/OFF contact 58. The ON/OFF lever arm 56 and the ON/OFF contact 58 are electrically connected to respective terminals 82, 84 that in turn electrically connect the lever arm 56 and ON/OFF contact 58 to the power circuit (FIG. 6) of the tool 10.

The ON/OFF contact 58 is secured to the switch body 50 proximate the trailing edge portion 66. The ON/OFF lever arm 56 comprises a beam structure formed of a conductive material such as stainless steel or spring steel. The lever arm 56 includes an attachment end portion 90 and a free end portion 88. The attachment end portion 90 is secured to the switch body 50 proximate the leading edge portion 64. The ON/OFF lever arm extends from the attachment end portion 86 toward the trailing edge portion 66 of the switch body 50 to position the free end portion 88 of the lever arm 56 in a position where it can be moved into and out of contact with the ON/OFF contact 58.

The free end portion 88 of the lever arm 56 is biased toward the switch body 50 and into contact with the ON/OFF contact 58 as depicted in FIG. 4. In one embodiment, the lever arm 56 is configured as a spring to bias the free end portion 88 toward the ON/OFF contact 58 although, in alternative embodiments, separate biasing structures may be utilized. When the free end portion 88 of the lever arm 56 is positioned in contact with the ON/OFF contact 58 (FIG. 4), the power circuit for the tool 10 is closed and power is supplied to the tool 10 (FIG. 6). The free end portion 88 of the lever arm 56 is configured to be moved away from the ON/OFF contact by the actuator 54 when the actuator 54 is at the OFF position (FIG. 3). When the free end portion 88 of the lever arm 56 is spaced apart from the ON/OFF contact 58, the power circuit for the tool 10 is opened and power to the control circuitry of the tool 10 is cut off.

The ON/OFF lever arm 56 includes a first bend portion 90 near the attachment end portion 86, a second bend portion 92 near the free end portion 88, and an intermediate portion 94 that extends between the first bend portion 90 and the second bend portion 92. The first bend portion 90 extends outwardly from switch body 50 to offset the intermediate portion 94 from the first main surface 60 of the switch body 50. The second bend portion 92 extends from the intermediate portion 94 generally toward the first main surface 60 and into the path of movement of the actuator 54. The second bend portion 92 also positions the free end portion 88 in a position to contact the ON/OFF contact 58.

As depicted in FIGS. 3 and 4, the first bend portion 90, the intermediate portion 94, and the second bend portion 92 cooperate to define a clearance area 96 around the path of movement of the actuator 54. The first bend portion 90 serves as the forward stop for the actuator 54 to prevent further forward movement of the actuator 54 beyond the forwardmost position (FIG. 4). The second bend portion 92 extends into the path of movement of the actuator 54 in order to be contacted by the actuator 54 as the actuator approaches the rearwardmost position (FIG. 3). The ON/OFF contact 58 serves as the rearward stop for the actuator 54 to prevent further movement of the actuator 54 in the rearward direction R.

When the actuator 54 is located forward of the OFF position in the clearance area as depicted in FIG. 4, the free end portion 88 of the lever arm 56 is biased into engagement with the ON/OFF contact 58 thus closing the power circuit so that power is provided to the tool 10. When the actuator 54 approaches the OFF position, the actuator 54 moves into contact with the second bend portion 92 of the lever arm 56, causing the lever arm 56 to deflect away from switch body 50 thereby moving the free end portion 88 of the lever arm 56 away from the ON/OFF contact 58 as depicted in FIG. 3. The second bend portion 92 has an angled or ramped shape to facilitate deflection of the lever arm away from the switch body 50 when the bend portion 92 is contacted by the actuator 54 moving in the rearward direction R.

When the actuator 54 reaches the OFF position (FIG. 3), the free end portion 88 of the lever arm is spaced apart from the ON/OFF contact forming a gap between the free end portion 88 of the lever arm and the ON/OFF contact 58. As a result, the power circuit is opened and power to the tool 10 is cut off. The actuator 54 remains interposed between the second bend portion 92 and the switch body 50 to maintain the gap between the free end portion 88 of the lever arm 56 and the ON/OFF contact 58 while the actuator 54 is in the OFF position.

The pressure applied to the actuator 54 in the OFF position by the second bend portion 92 helps maintain the actuator 54 in the OFF position and prevent inadvertent movement of the actuator 54 away from the OFF position. When the actuator 54 is moved forward from the OFF position by an operator of the tool 10, the actuator 54 moves out of contact with the second bend portion of the lever arm and into the clearance area 96, thus allowing the free end portion 88 of the lever arm 56 to move into contact with the ON/OFF contact 58 as depicted in FIG. 4.

The slide switch 14 is mounted to the housing 22 of the tool 10 with the first main surface 60 facing inwardly toward the interior of the housing and the second main surface facing away from the interior of the housing. A stem or post 98 extends from the portion of the actuator 54 located in front of the second main surface 62 of the switch body. The stem 98 extends through a slot 102 defined in the housing of the tool (FIGS. 1 and 5A-5C). In one embodiment, the slot 102 is defined along the interface between two housing shell portions 22*a*, 22*b* that are attached in a clamshell configuration (FIGS. 5A-5C).

The slot 102 in the housing provides clearance for the stem 98 to move the actuator 54 along its full path of movement between the ON/maximum position (FIG. 4) and the OFF position (FIG. 3). A switch knob or button 104 is attached to the stem 102 exterior to the housing to facilitate manipulation of the actuator by a user of the tool. Indicator markings 108 may be provided on the housing 22 alongside the slot 102 to identify the operating speeds that correspond to the switch positions.

FIG. 5A shows the switch knob 104 in the OFF position. FIG. 5B shows the switch knob 104 in an ON/intermediate speed position. FIG. 5C shows the switch knob 104 in the ON/maximum speed position. The slide switch 14 is mounted to the tool 10 with the path of movement of the actuator 54 aligned with the longitudinal axis L. This arrangement allows the user to easily to move the switch knob 104 between the ON/maximum speed position (FIG. 5C) and the OFF position (FIG. 5A) and vice versa in one smooth motion.

Providing all of the circuit components of the switch on one side of the switch body and facing that side of the switch body toward the interior of the housing 22 helps to prevent contamination of the switch components by debris entering the housing. Although not depicted, a dust boot or dust cover mechanism may be provided to prevent or limit the chance of debris entering the housing through the slot 102.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A power tool comprising:

a housing that has a substantially cylindrical shape defining a longitudinal axis;

a variable speed motor supported by the housing;

a drive member coupled to the motor and defining an axis of rotation that is aligned with the longitudinal axis, the drive member including a tool holder located exterior to the housing;

a variable speed signal generator that generates a variable speed control signal indicating an operating speed for the motor, the operating speed being dependent upon a value of a variable speed selection signal;

a power circuit that electrically connects the variable speed motor to a power source;

a slide switch attached to the housing, the slide switch including i) a slide potentiometer that outputs the variable speed selection signal, and ii) an actuator configured to slide between a first position and a second position in relation to the slide potentiometer, the variable speed selection signal having a value that varies corresponding to a position of the actuator in relation to the slide potentiometer;

wherein the slide switch includes an ON/OFF contact and an ON/OFF lever arm that is movable into and out of contact with the ON/OFF contact, the ON/OFF contact and the ON/OFF lever arm being electrically connected to the power circuit such that the power circuit is closed when the ON/OFF lever arm is positioned in contact with the ON/OFF contact and the power circuit is opened when the ON/OFF lever arm is spaced apart from the ON/OFF contact, wherein, when the actuator is located at the first position, the actuator prevents the ON/OFF lever arm from contacting the ON/OFF contact, wherein, when the actuator is away from the first position, the ON/OFF lever arm is positioned in contact with the ON/OFF contact, wherein the slide potentiometer is supported by a switch body, the actuator being slidably supported by the switch body, and wherein the switch body defines a linear path of movement for the actuator, the slide switch being attached to a longitudinal side the housing with the linear path of movement aligned with the longitudinal axis of the housing.

2. A power tool comprising:

a housing defining a longitudinal axis;

a variable speed motor supported by the housing;

a drive member coupled to the motor and defining an axis of rotation that is aligned with the longitudinal axis, the drive member including a tool holder located exterior to the housing;

a variable speed signal generator that generates a variable speed control signal indicating an operating speed for the motor, the operating speed being dependent upon a value of a variable speed selection signal;

a power circuit that electrically connects the variable speed motor to a power source;

a slide switch attached to the housing, the slide switch including i) a slide potentiometer that outputs the variable speed selection signal, and ii) an actuator configured to slide between a first position and a second position in relation to the slide potentiometer, the variable speed selection signal having a value that varies corresponding to a position of the actuator in relation to the slide potentiometer;

wherein the slide switch includes an ON/OFF contact and an ON/OFF lever arm that is movable into and out of contact with the ON/OFF contact, the ON/OFF contact and the ON/OFF lever arm being electrically connected to the power circuit such that the power circuit is closed when the ON/OFF lever arm is positioned in contact with the ON/OFF contact and the power circuit is opened when the ON/OFF lever arm is spaced apart from the ON/OFF contact, wherein, when the actuator is located at the first position, the actuator prevents the ON/OFF lever arm from contacting the ON/OFF contact, wherein, when the actuator is away from the first position, the ON/OFF lever arm is positioned in contact with the ON/OFF contact, wherein the slide potentiometer is supported by a switch body, the actuator being slidably supported by the switch body, and wherein the switch body defines a linear path of movement for the actuator, the slide switch being attached to the housing with the linear path of movement aligned with the longitudinal axis of the housing, wherein the ON/OFF lever arm includes an attachment end portion and a free end portion, the attachment end portion being attached to the switch body, the free end portion being positioned for movement into and out of contact with the ON/OFF contact, wherein the ON/OFF lever arm comprises a spring that biases the free end portion of the ON/OFF lever arm toward the ON/OFF contact, and wherein the ON/OFF lever arm extends into the path of movement of the actuator at a position to be contacted by the actuator when the actuator approaches the first position.

3. The power tool of claim 2, wherein the actuator deflects the ON/OFF lever arm away from the switch body causing the free end portion of the ON/OFF lever arm to move away from the ON/OFF contact as the actuator approaches the first position.

4. The power tool of claim 3, wherein the ON/OFF lever arm is spaced apart from the actuator when the actuator is away from the first position.

5. The power tool of claim 2, wherein the ON/OFF contact serves as a first stop for the actuator that prevents movement of the actuator beyond the first position, and wherein the ON/OFF lever arm serves as a second stop for the actuator that prevents movement of the actuator beyond the second position.

6. A rotary power tool comprising:

a housing defining a longitudinal axis;

a drive member defining an axis of rotation aligned with the longitudinal axis;

a variable speed motor coupled to the drive member;

a power circuit for electrically coupling the variable speed motor to a power source; and a slide switch including a switch body, a slide potentiometer attached to the switch body, an actuator slidably supported by the switch body, a lever arm pivotably attached to the switch body, and an ON/OFF contact attached to the switch body, the lever arm and the ON/OFF contact being electrically connected to the power circuit;

wherein the switch body defines a linear path of movement for the actuator that is aligned with the longitudinal axis, wherein the slide potentiometer outputs a variable speed selection signal that indicates an operating speed for the variable speed motor, the variable speed selection signal having a value that is dependent upon a position of the actuator with respect to the slide potentiometer, wherein the lever arm is biased into contact with the ON/OFF contact to close the power circuit, wherein the actuator deflects the lever arm away from the ON/OFF contact when the actuator is in an OFF position in relation to the switch body, and wherein the ON/OFF contact serves as a first stop for the actuator that prevents movement of the actuator beyond a first position in a rearward direction, and wherein the ON/OFF lever arm serves as a second stop for the actuator that prevents movement of the actuator beyond a second position in a forward direction.

7. The power tool of claim 6, wherein the first position corresponds to the OFF position.

8. A slide switch for a power tool, comprising:

a switch body that includes a leading edge and a trailing edge;

an actuator configured to slide along the switch body along a longitudinal axis extending from the leading edge of the switching body to the trailing edge of the switching body;

a forward stop proximate to the leading edge and a rearward stop proximate to the trailing edge that are configured to limit motion of the actuator along the longitudinal axis;

a slide potentiometer mounted on the switch body along the longitudinal axis, and extending along the longitudinal axis from the forward stop to a location between the forward stop and the rearward stop, the slide potentiometer configured to generate a variable speed control signal for controlling the operating speed of a variable speed motor of the power tool, the control signal corresponding to a position of the actuator in relation to the slide potentiometer;

an ON/OFF contact positioned on the switch body proximate to the trailing edge; and an ON/OFF lever pivotably connected to the switch body so as to be moveable into and out of contact with the ON/OFF contact, wherein:

the ON/OFF lever is configured to close a circuit between the motor of the power tool and a power source to enable operation of the power tool by coming into contact with the ON/OFF contact, such that the circuit is opened when the ON/OFF lever is spaced away from the ON/OFF contact;

the ON/OFF lever is biased towards the ON/OFF contact; and the actuator is configured to deflect the ON/OFF lever away from the ON/OFF contact as the actuator moves beyond the slide potentiometer in the direction towards the trailing edge of the switch body.

9. The slide switch according to claim 6, wherein the ON/OFF lever is pivotably connected to the switch body proximate to the leading edge.

10. The slide switch according to claim 6, wherein the ON/OFF lever includes a first bend proximate to the leading edge that forms the forward stop.

11. The slide switch according to claim 6, wherein the ON/OFF lever includes a second bend that extends into a path of motion of the actuator such that the actuator bears against the second bend and deflects the ON/OFF lever away from the ON/OFF contact as the actuator moves beyond the slide potentiometer in the direction towards the trailing edge.

12. The slide switch according to claim 6, wherein the ON/OFF contact forms the rearward stop.

* * * * *